United States Patent [19]

Takeuji

[11] Patent Number: 4,559,428

[45] Date of Patent: Dec. 17, 1985

[54] OVEN DOOR WITH INTEGRAL CHOKE MECHANISM AND MICROWAVE ABSORBER

[75] Inventor: Koichi Takeuji, Nara, Japan

[73] Assignee: Sharp Kabushiki Kaisha, Osaka, Japan

[21] Appl. No.: 537,167

[22] Filed: Sep. 30, 1983

Related U.S. Application Data

[63] Continuation of Ser. No. 294,246, Aug. 19, 1981, abandoned.

[30] Foreign Application Priority Data

Aug. 26, 1980 [JP] Japan ..... 55-121351[U]

[51] Int. Cl.[4] ..... H05B 6/76

[52] U.S. Cl. ..... 219/10.55 D; 174/35 MS

[58] Field of Search ..... 219/10.55 R, 10.55 D; 174/35 GC, 35 MS

[56] References Cited

U.S. PATENT DOCUMENTS

| | | | |
|---|---|---|---|
| 3,742,176 | 6/1973 | Ishino et al. | 219/10.55 |
| 3,843,859 | 10/1974 | Klemp et al. | 174/35 GC |
| 3,846,608 | 11/1974 | Valles | 174/35 GC |
| 3,866,009 | 2/1975 | Ishino et al. | 219/10.55 D |
| 3,985,993 | 10/1976 | Imberg et al. | 219/10.55 D |
| 4,046,983 | 9/1977 | Ishino et al. | 174/35 MS |
| 4,051,341 | 9/1977 | Tanaka et al. | 219/10.55 D |
| 4,053,731 | 10/1977 | Foerstner | 174/35 GC |
| 4,137,441 | 1/1979 | Bucksbaum | 219/10.55 D |
| 4,146,768 | 3/1979 | Orke | 219/10.55 D |
| 4,166,207 | 8/1979 | Burke | 219/10.55 D |
| 4,313,044 | 1/1982 | Staats | 174/35 MS |

FOREIGN PATENT DOCUMENTS

| | | | |
|---|---|---|---|
| 52-19341 | 2/1977 | Japan | 219/10.55 D |
| 1327806 | 8/1973 | United Kingdom . | |
| 1342672 | 1/1974 | United Kingdom . | |
| 1351457 | 5/1974 | United Kingdom . | |
| 2007474 | 5/1979 | United Kingdom . | |
| 1549593 | 8/1979 | United Kingdom . | |
| 1571838 | 8/1980 | United Kingdom . | |

*Primary Examiner*—C. L. Albritton
*Assistant Examiner*—Geoffrey S. Evans
*Attorney, Agent, or Firm*—Birch, Stewart, Kolasch & Birch

[57] ABSTRACT

An oven door in a microwave oven contains a door frame having a choke mechanism formed therein. A choke cover for covering the choke mechanism is secured to the door frame. The choke cover is made of a wave absorbing material. A portion of the choke cover is extended to cover one surface of the door frame so that the extended portion of the choke cover contacts a front end of the oven wall when the oven door is closed. That is, the extended portion of the choke cover functions as a wave absorber for preventing the leakage of the microwave energy from the microwave oven.

4 Claims, 7 Drawing Figures

FIG. 1
PRIOR ART
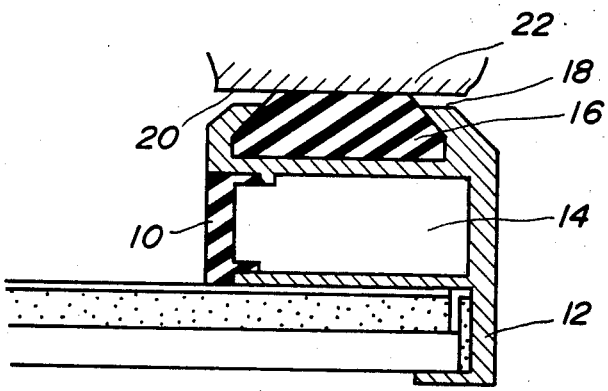
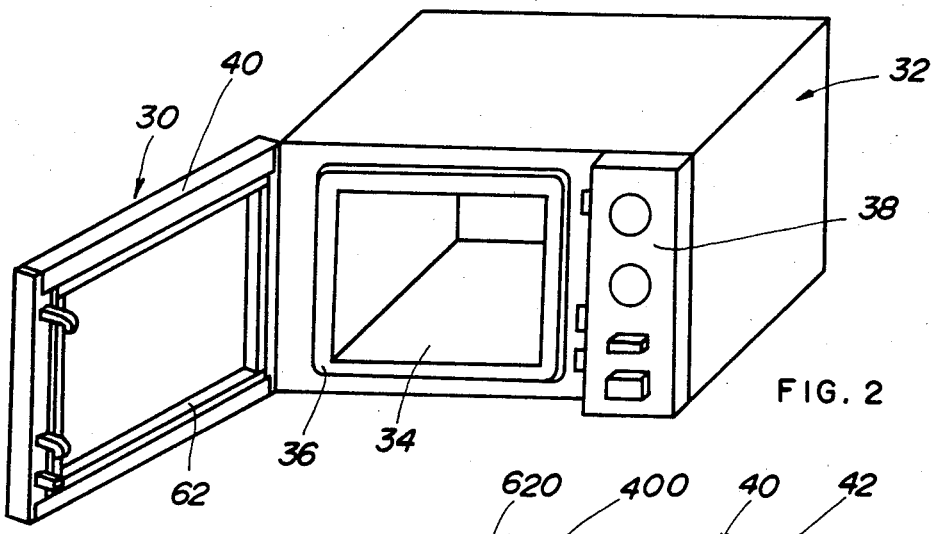
FIG. 2
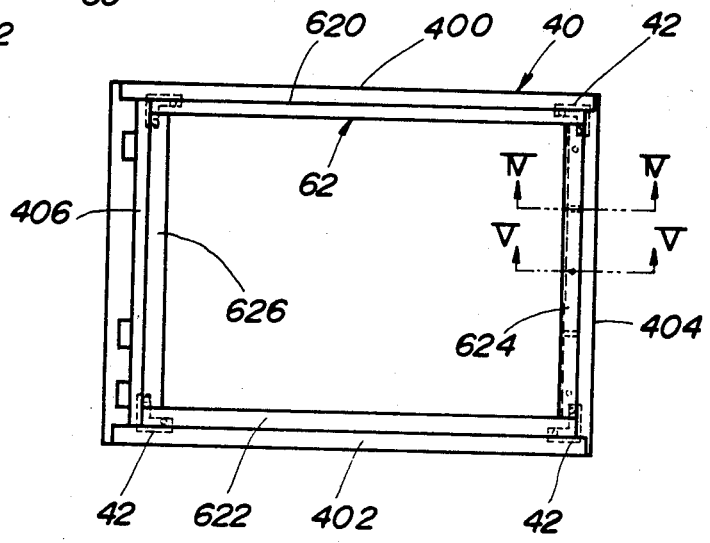
FIG. 3

OVEN DOOR WITH INTEGRAL CHOKE MECHANISM AND MICROWAVE ABSORBER

This application is a continuation of application Ser. No. 294,246, filed on Aug. 19, 1981 now abandoned.

BACKGROUND AND SUMMARY OF THE INVENTION

The present invention relates to an oven door construction in a microwave oven.

A microwave oven door must have a choke mechanism and a wave absorber in order to prevent microwave leakage. In the conventional microwave oven, a choke cover is discrete from the wave absorber and, therefore, the fabrication of the oven door is made complicated.

Accordingly, an object of the present invention is to provide an oven door of a simple construction for use in a microwave oven.

Another object of the present invention is to provide an oven door which shortens the time period required for fabricating the same.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a choke mechanism is secured to a frame of an oven door in a microwave oven. A choke cover is provided for preventing the blocking of the choke mechanism. The choke cover is made of a wave absorbing material such as ferrite material. The choke cover is extended to cover a surface of the door frame, the surface confronting the front surface of an oven wall. In this way, the extended portion of the choke cover functions as a wave absorber. That is, the wave absorber is integral with the choke cover.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 1 is a sectional view of an essential part of a microwave oven door of the prior art;

FIG. 2 is a perspective view of a microwave oven employing an embodiment of an oven door of the present invention;

FIG. 3 is a rear view of the oven door of FIG. 2;

DESCRIPTION OF THE PREFERRED EMBODIMENTS

Figure 4:
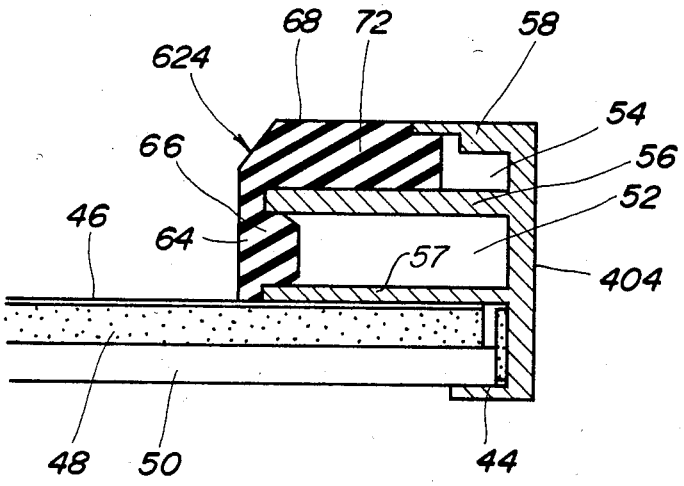
FIG. 4 is a sectional view of an essential part of the oven door taken along line IV—IV of FIG. 3.

Referring now in detail to the drawings, and to facilitate a more complete understanding of the present invention, a typical construction of an oven door of the prior art will be first described with reference to FIG. 1.

Generally, an oven door of a microwave oven includes a choke mechanism and a wave absorber secured to a frame of the oven door. In the conventional system, a choke cover 10 is secured to a door frame 12 for convering a choke mechanism 14. The choke cover 10 is required for preventing the blocking of the choke mechanism 14. A wave absorber 16 made of elastic ferrite is secured to a surface 18 of the door frame 12. The surface 18 confronts of front end 20 of an oven wall 22. That is, the wave absorber 16 is discrete from the choke cover 10. Thus, the fabrication of the oven door is complicated.

FIG. 2 shows a microwave oven employing an embodiment of an oven door of the present invention.

An oven door 30 is rotatably secured to a body 32 of a microwave oven. The microwave oven includes an oven cavity 34 defined by oven walls 36 and a control panel 38 disposed at the front surface of the body 32. The oven door 30 includes a door frame 40.

Figure 5:
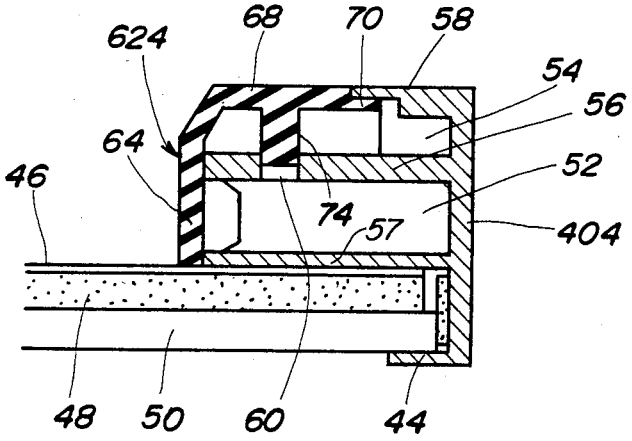
FIG. 5 is a sectional view of an essential part of the oven door taken along line V—V in FIG. 3.

FIGS. 3 through 5 show the construction of the oven door 30. The door frame 40 comprises an upper frame 400, a bottom frame 402 and side frames 404 and 406. The frames 400, 402, 404 and 406 are fixed to each other by angles 42 as shown in FIG. 3. The door frame 40 includes a supporting section 44 as shown in FIGS. 4 and 5. The supporting section 44 functions to support a feeder, which comprises a metal plate 46 having a plurality of openings formed therein and coated by a transparent polyester film, a cushion member 48 and a windowpane 50. The door frame 40 is shaped to form a choke mechanism 52 and a cover supporting section 54 which confronts the front end of the oven walls 36 when the oven door 30 is closed. More specifically, the door frame 40 includes partition walls 56 and 57 for determining the choke mechanism 52, and a cover supporting member 58. The cover supporting member or second support section 58 has a length of substantially a half of the partition wall 56. The partition wall 56 is provided with several openings 60 formed in predetermined positions.

A choke cover 62 is provided to cover the choke mechanism 52 in order to prevent the blocking of the choke mechanism 52. The choke cover 62 comprises a choke cover 620 secured to the upper door frame 400, a choke cover member 622 secured to the bottom door frame 402, and members 624 and 626 secured to the side door frames 404 and 406, respectively. The choke cover 62 is made of an elastic wave absorbing material and, preferably, made of ferrite. The members of the choke cover 62 includes a choke cover section 64 confronting the choke mechanism 52 when the choke cover 62 is secured to the door frame 40. Several protruded portions 66 are formed in the choke cover 62 to ensure a tight covering of the choke mechanism 52. The choke cover 62 includes an extended portion 68 which confronts the front end of the oven walls 36 when the oven door 30 is closed, thereby functioning as the wave absorber. At the end of the extended portion 68, a stair portion 70 is provided which is received by the cover supporting member 58 when the choke cover 62 is secured to the door frame 40. Several reinforcing portions 72 are formed in the coke cover 62 at the position where the protruded portions 66 are formed. Further, several poles 74 are integrally formed in the choke cover 62 at the positions corresponding to the openings 60 formed in the partition wall 56. The poles 74 and the openings 60 function, in combination, to ensure a tight fitting of the choke cover 62 to the door frame 40. The above-mentioned choke cover section 64, the protruded portions 66, the extended portion 68, the stair portion 70, reinforcing portions 72 and poles 74 are integral with each other.

Figure 6:
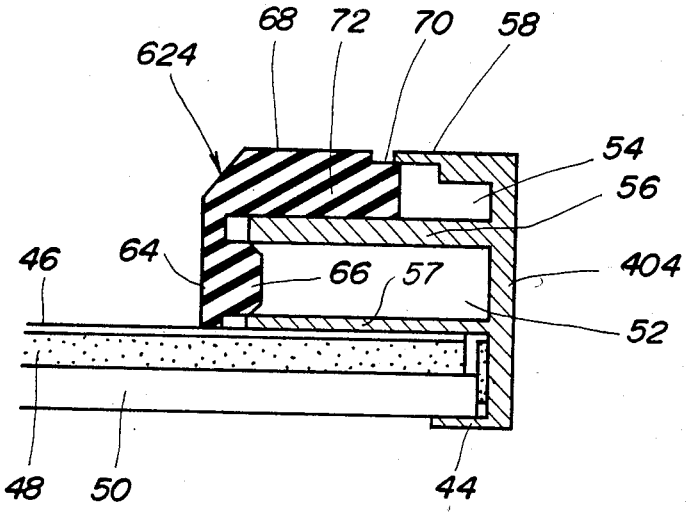
FIG. 6 is a sectional view, corresponding to FIG. 4, for explaining a fabrication step of the oven door of FIG. 3.
Figure 7:
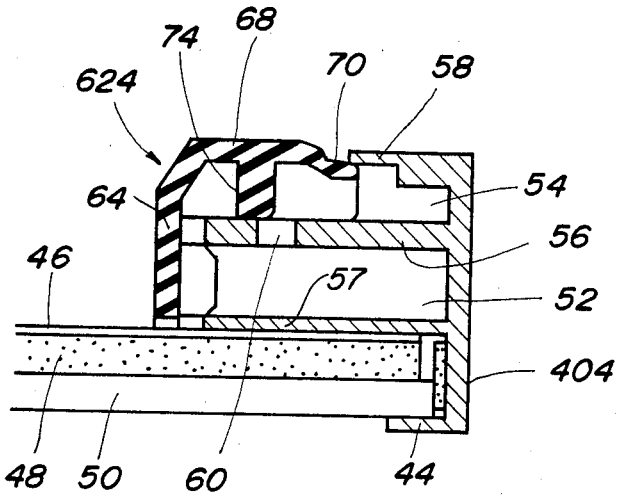
FIG. 7 is a sectional view, corresponding to FIG. 5, for explaining a fabrication step of the oven door of FIG. 3.

FIGS. 6 and 7 show a condition where the choke cover 62 is being secured to the door frame 40. FIG. 6 shows a portion corresponding to FIG. 4, and FIG. 7 shows a portion corresponding to FIG. 5.

The choke cover 62 is slid along the fender 46 toward the door frame 40 until the stair portion 70 is inserted into the cover supporting section 54. The choke cover 62 is slightly bent at the position where the pole 74 is formed because the pole 74 contacts the partition wall 56 as shown in FIG. 7. The choke cover 62 is further slid to insert the pole 74 into the opening 60 formed in the partition wall 56. At this moment, the stair portion 70 is tightly received by the cover supporting member 58.

The invention being thus described, it will be obvious that the same may be varied in many ways. Such variations are not be regarded as a departure from the spirit and scope of the invention, and all such modifications are intended to be included within the scope of the following claims.

What is claimed is:

1. An oven door for a microwave oven said oven comprising walls having front ends juxtapositioned to said door when said door is closed comprising in combination:

a door frame including:

a first support section for supporting a fender member including a windowpane, first and second partition walls for defining a choke mechanism area, and a second support section extending from an disposed adjacent said first partition wall external to said choke mechanism area, said second support section having a stepped portion; and a choke cover secured to said door frame made of a microwave absorbing material, said choke cover including a choke cover section for closing off said choke mechanism area when said choke cover is secured to said door frame and an extended portion of said choke cover which confronts said front ends of said walls of said oven when said oven door is closed, said extended portion of said choke cover being provided with a stepped portion which meshes with said stepped portion of said second support section when said choke cover is secured to said door frame, said choke cover section being integral with said extended portion and comprising the same microwave absorbing material.

2. The oven door of claim 1, wherein said extended portion of said choke cover is provided with a plurality of integrally formed pole members and said first partition wall is provided with a plurality of apertures for receiving said corresponding pole members to ensure a tight securing of said choke cover to said door frame.

3. The oven door of claim 1, wherein said microwave absorbing material comprises an elastic ferrite material.

4. The oven door of claim 1, wherein said choke cover is provided with protruding portions which cooperate with said first and second partition walls and extend into said choke mechanism area.

* * * * *